US007470137B2

(12) United States Patent
Burke et al.

(10) Patent No.: US 7,470,137 B2
(45) Date of Patent: Dec. 30, 2008

(54) QUICK-RELEASE CONNECTOR

(75) Inventors: William Henry Burke, Shoreline, WA (US); Sena R Janky, Sammamish, WA (US); Corey B Vettleson, Arlington, WA (US)

(73) Assignee: Fluke Corporation, Everett, WA (US)

( * ) Notice: Subject to any disclaimer, the term of this patent is extended or adjusted under 35 U.S.C. 154(b) by 0 days.

(21) Appl. No.: 11/392,249

(22) Filed: Mar. 29, 2006

(65) Prior Publication Data

US 2007/0232115 A1 Oct. 4, 2007

(51) Int. Cl.
*H01R 4/50* (2006.01)

(52) U.S. Cl. ..... 439/344

(58) Field of Classification Search ..... 439/344, 439/357, 923, 358, 676, 352, 525, 353–354, 439/557

See application file for complete search history.

(56) References Cited

U.S. PATENT DOCUMENTS

| | | | | |
|---|---|---|---|---|
| 4,541,036 | A * | 9/1985 | Landries et al. | 361/823 |
| 5,897,142 | A * | 4/1999 | Kulevsky | 285/308 |
| 7,029,311 | B2 * | 4/2006 | Peloza | 439/357 |
| 7,204,721 | B2 * | 4/2007 | Lundholm et al. | 439/676 |
| 2006/0110976 | A1 * | 5/2006 | Osada et al. | 439/525 |

* cited by examiner

*Primary Examiner*—Edwin A. Leon
(74) *Attorney, Agent, or Firm*—Christensen O'Connor Johnson Kindness PLLC

(57) ABSTRACT

A connector includes a locking mechanism that locks the connector in a socket but allows removal of the connector without a manual operation that relies on depressing the locking mechanism. The connector is released from the socket when a sufficient pulling force is applied to the connector. The connector includes a spring-loaded detent that flexes during the insertion process. The detent snaps into a locking position. The detent can be released from the socket when sufficient tension is applied on the connector such that inadvertent tension will not result in breaking the connector.

14 Claims, 5 Drawing Sheets

QUICK-RELEASE CONNECTOR

BACKGROUND

Conventional connectors that are at the terminal ends of cables of electronic equipment normally include a latching mechanism to retain the connector within a socket. Conventional connectors may include manually-depressible "tabs" that are depressed when inserted into a socket. The tabs then spring back to retain the connector in place. However, releasing the connector requires manually depressing the tabs. Conventionally, the latching mechanism is made of plastic, which is fragile. Since the only means for releasing the connector from the socket is by manually depressing the tabs, the latching mechanism will break when tension is inadvertently placed on the cable.

SUMMARY

A connector includes a locking mechanism that locks the connector in a socket, but allows removal of the connector without a manual operation in a "quick-release" fashion. The connector is released from the socket when a sufficient pulling force is applied to the connector without the need for depressing a tab or the like. The connector includes a cantilever detent, which flexes during the insertion process. The detent snaps into position for locking the connector to a socket. The detent is released from the socket when sufficient tension is applied on the connector or the cable to release the detent. In this way, inadvertent tension will not result in breaking the connector.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
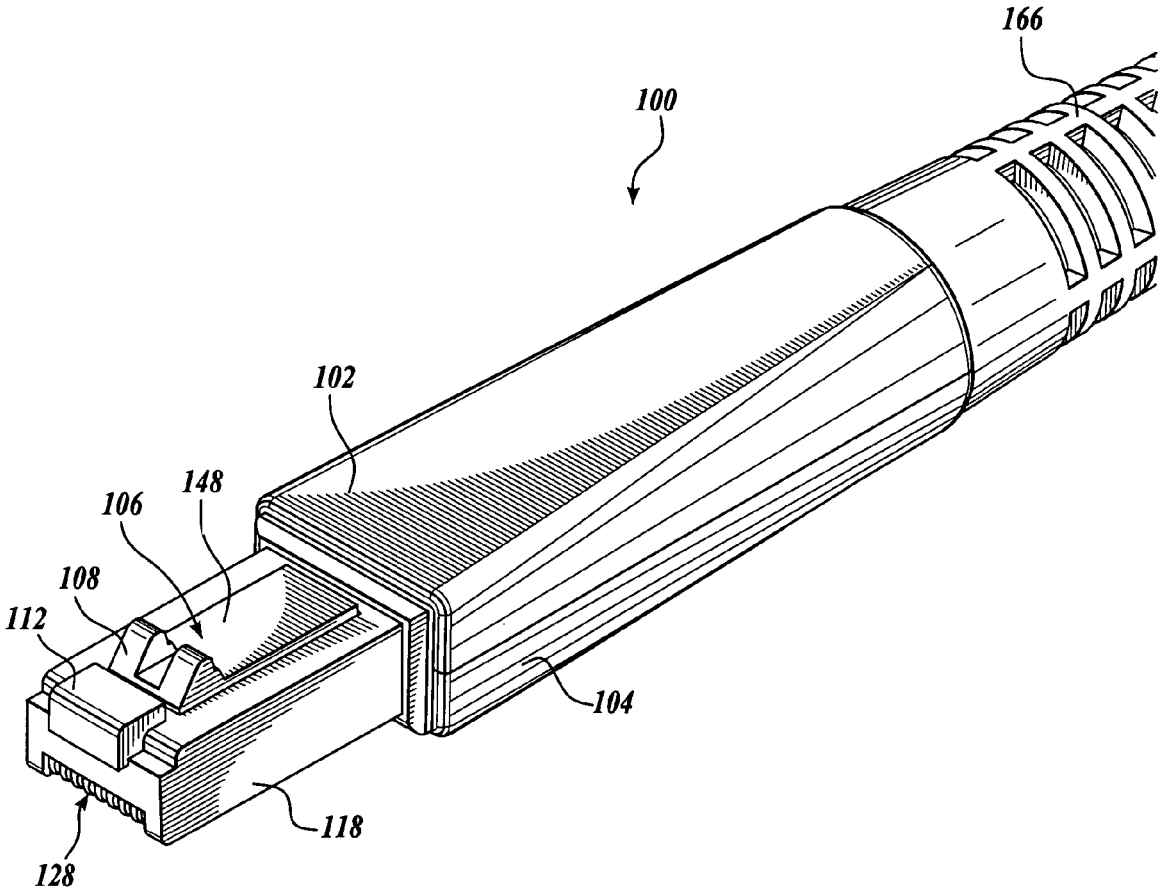
FIG. 1 is an illustration of a quick-release connector 100 in accordance with one embodiment of the present invention.

FIG. 1 is an illustration of a quick-release connector 100 in accordance with one embodiment of the present invention. The connector 100 includes an upper housing 102 and a lower housing 104. It is to be appreciated that directional language used throughout this application is with reference to the figures and is not limiting of the claims or of the invention. The upper housing 102 and lower housing 104 can be made of metal or a plastic material. The housing parts 102 and 104 connect to and detain a cable 166 therein. The cable 166 may be a shielded, twisted cable if the connector 100 is an RJ-45 connector. Although one embodiment is described as an RJ-45 connector, other connectors are within the scope of the invention. The description of an RJ-45 connector is not intended to limit the claims or the present application to any particular configuration. "RJ-45" is a well-known designation for a particular style of connector. The pin arrangement, pin number, voltage level, and line capacitance for RJ-45 connectors and cables are dictated by standards, which will not be described herein for brevity.

The upper housing 102 is connected to a male connector portion 118. The male connector portion 118 is the portion of the connector 100 that is inserted into a female socket receptacle. The male connector portion 118 includes a first and a second side that are placed laterally and medially with respect to a frontal wall. The side and frontal walls define an opening therein for the placement of a locking mechanism 106, as will be described further below. The distal end of the male connector portion 118 includes "pins" 128. The pins 128 include electrical contacts, such as thin copper strips. Each of the pins 128 is separated by a dividing wall. The pins 128 are arranged from side to side between the lateral and medial walls of the male connector portion 118. The male connector portion 118 includes a frontal guide block 112 placed on the frontal wall of the male connector portion 118. The frontal guide block 112 assists in guiding the male connector portion 118 into a corresponding socket. The locking mechanism 106 includes a flexible tang 148 or tongue. The tang 148 of the locking mechanism 106 is generally flat and planar. The proximal side of the tang 148 is connected to a base 110 (shown in FIG. 2). Proximal, as used in this application, refers to the side of a component or object which is nearer to the cable 166. Distal, as used in this application, refers to the side of a component or object that is farthest from the cable 166. The distal side of the tang 148 includes a detent 108, which projects in an upward fashion above the plane of the tang's 148 upper surface. Three sides of the tang 148 are detached from the base 110 such that the distal side of the tang 148, which includes the detent 108, can flex downwards and upwards. The detent 108 has a pyramidical profile. In other words, the distal side and the proximal side of the detent 108 slopes from an apex downward to the upper surface of the tang 148. The detent's 108 apex reaches an elevation that is higher than the upper surface of the frontal guide block 112.

Figure 2:
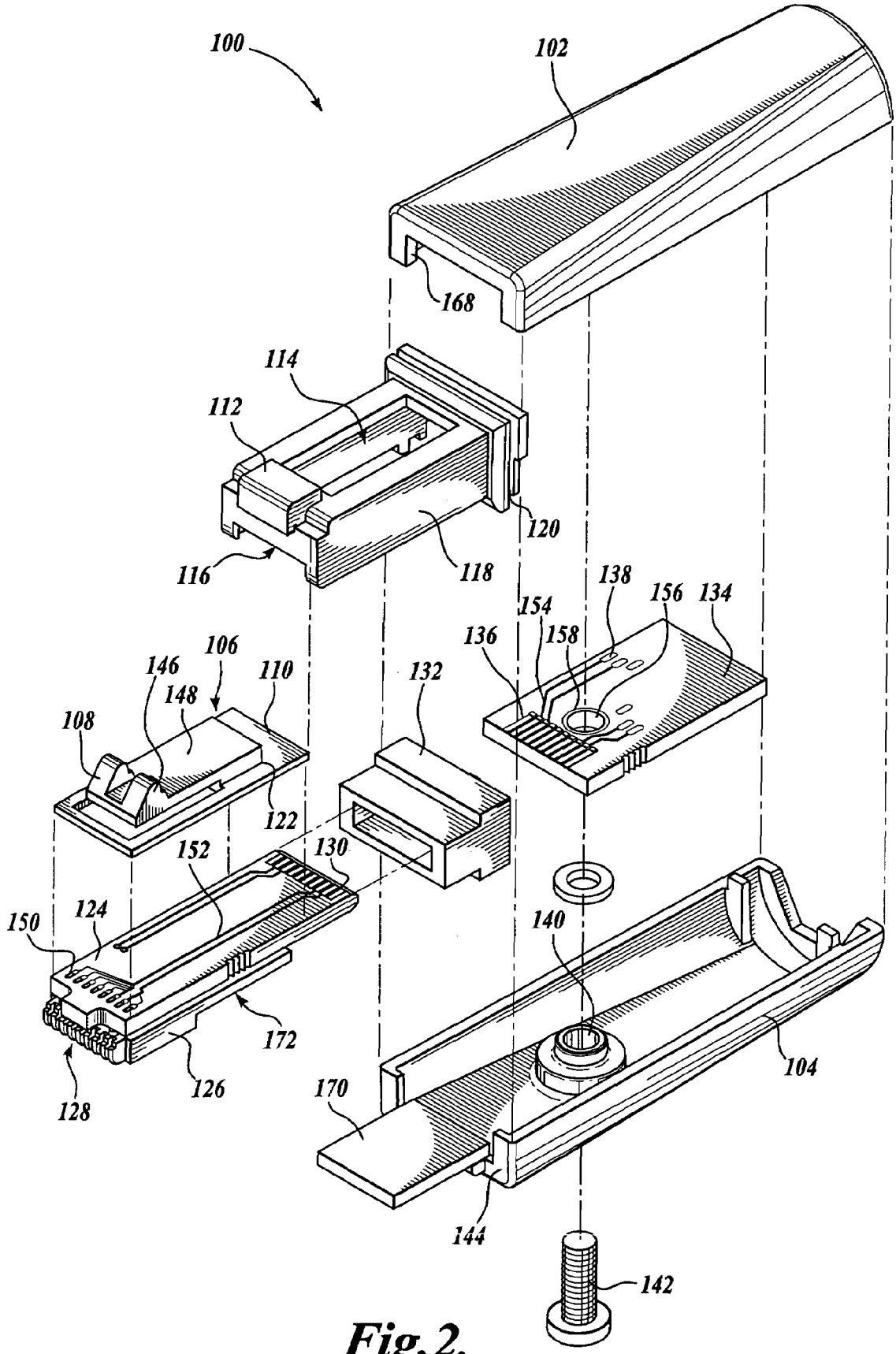
FIG. 2 is an illustration of the components of a quick-release connector in accordance with one embodiment of the present invention.

FIG. 2 illustrates the individual components of the connector 100 in accordance with one embodiment of the present invention. The upper housing 102 and the lower housing 104 define a cavity therein for the placement of the various components. The proximal end of the upper housing 102 and of the lower housing 104 includes a slot disposed perpendicular to the cable 166. The opening for the cable 166 created by the upper housing 102 and the lower housing 104 create a hexagonal shape, which prevents rotation of the cable 166. The slot is provided in the upper housing 102 and the lower housing 104 for retaining a corresponding ridge of the cable 166. The distal end of the upper housing 102 includes an edge wall 168 that protrudes slightly inwards. The male connector portion 118 has a slot 120 that extends on three sides at the proximal end of the male connector portion 118. The slot 120 engages the edge wall 168 to join the male connector portion 118 to the upper housing 102. Similarly, the lower housing 104 has an edge wall 144 on two sides, such sides being the lateral and medial sides to engage the slot 120 of the male connector portion 118.

Figure 6:
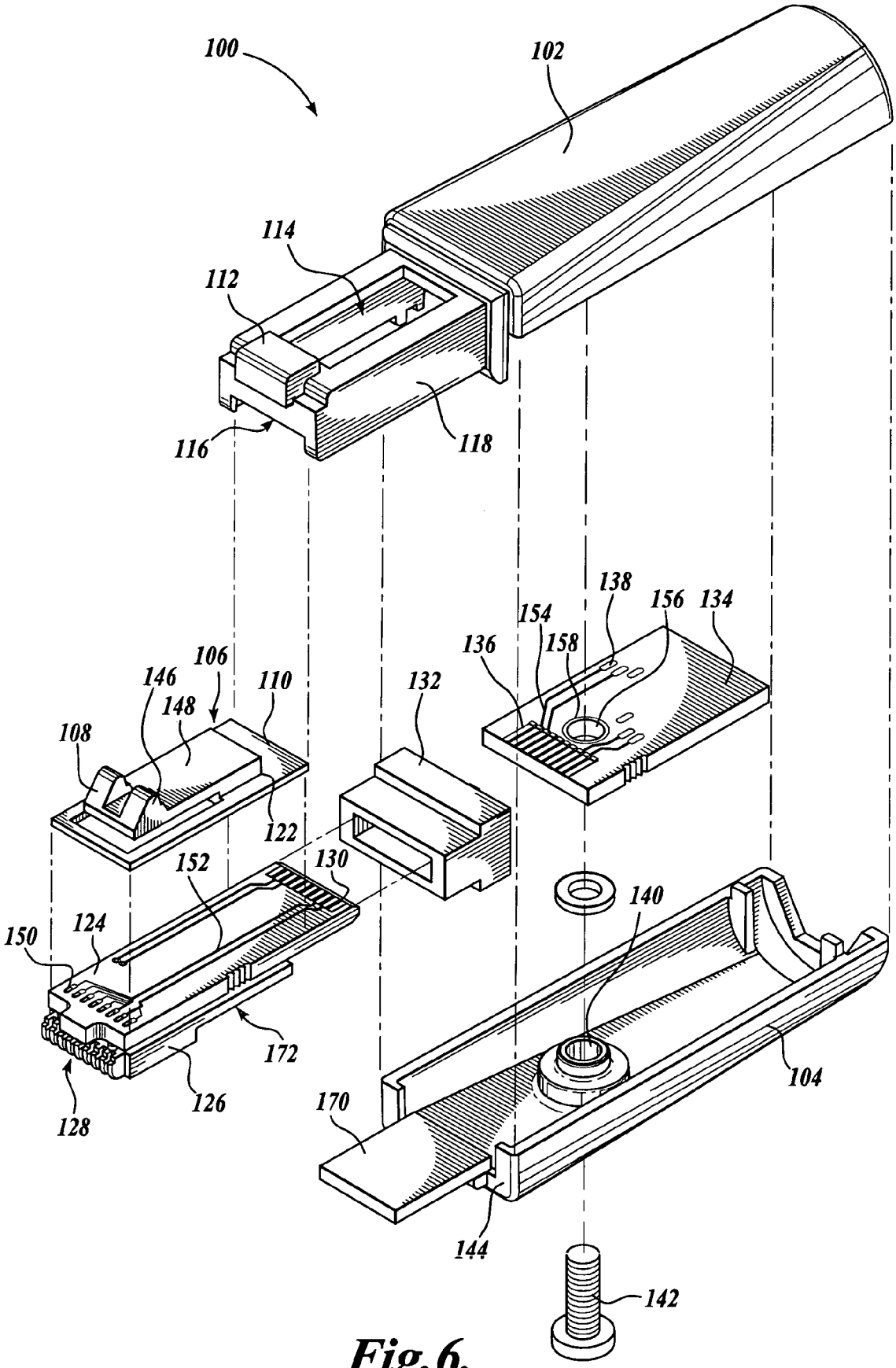
FIG. 6 is an illustration of the components of a quick-release connector in accordance with one embodiment of the present invention.

The male connector portion 118 may be a discrete and separate component, as illustrated in FIG. 2, or the male connector portion 118 may be integrally combined with the upper housing 102, as illustrated in FIG. 6. The embodiment of the quick-release connector 100 in FIG. 6 is in other respects similar to the embodiment of FIG. 2, wherein like reference numbers denote corresponding components. The male connector portion 118 includes a lateral wall and a medial wall and a frontal, distal wall that defines a central opening 114. The frontal, distal wall includes a slot 116 that allows the pins 128 to be accessible therethrough. The locking mechanism 106 is placed immediately below the male connector portion 118 and is inserted such that the tang 148 and detent 108 are visible through the opening 114. The locking mechanism 106 includes the base portion 110, which extends a small distance on all four sides of the tang 148. The tang 148 is cut from the base 110 at the distal side and partially at the lateral and medial sides. The entire proximal side and partly the lateral and medial sides of the tang 148 are connected to the base 110 at a connection point 122. At least the distal side of the tang 148 can flex upwards and downwards. Furthermore, the tang 148 is cantilevered to flex and return to the horizontal position after deflection. The tang's 148 upper surface is proud of the upper surface of the base portion 110. The distal side of the tang 148 includes the detent 108 on the upper surface of the tang 148. As mentioned above, the detent 108 has a pyramidical profile when viewed from the side. A forward sloping side and a rear sloping side define the detent 108 when viewed from the lateral or medial side. The detent 108 also includes a first and second tooth disposed on the lateral and medial side of the tang 148, with a gap separating the first and second tooth. Each tooth of the detent 108 includes a small step 146 or shoulder at the rear sloping side. The front and the rear sloping sides may or may not have the same angle of repose or inclination. The front and rear sloping sides of each of the teeth of the detent 108 can have a different degree of sloping to vary the resistance for inserting and releasing the connector 100 from a socket.

Immediately below the locking mechanism 106, a printed circuit board 124 is provided. The printed circuit board 124 includes solder joints 150 for each of the electrical pins 128. An RJ-45 connector can have eight (8) pins. Though, other connectors may have more or less than eight (8) pins. The printed circuit board 124 can be made from fiberglass laminated with epoxy resin. Copper lines 152 may be encapsulated with the fiberglass and epoxy construction. Copper lines 152 connect the solder joints 150 at the distal side of the printed circuit board 124 to electrical contact pads 130 at the proximal side of the printed circuit board 124. Pins 128 are in electrical contact with the copper pads 130 through the solder joints 150 and the copper lines 152. Copper lines 152 may appear on the upper or lower surface of the printed circuit board 124 or at an intermediate level, depending on the amount of surface real estate available on the printed circuit board 124.

Immediately below the printed circuit board 124 is a pin holder 126. The pin holder 126 is for retaining the electrical contact pins 128. The pin holder 126 includes dividing walls between each of the electrical contact pins 128 and at the exterior sides of the two side contact pins 128. The pin holder 126 is connected to the printed circuit board 124 via the solder joints 150. Alternatively, the pin holder 126 may be adhered to the printed circuit board 124 via an adhesive or a mechanical fastener.

An internal, intermediate connector 132 is provided for ease in assembly of the connector 100. The internal, intermediate connector 132 provides for electrical contact between the first printed circuit board 124 and a second printed circuit board 134, which will be described below. The internal, intermediate connector 132 includes matching contact pads or pins (not shown) for each of the electrical contacts 130 of circuit board 124 and an equal number of corresponding contacts for the printed circuit board 134. The internal, intermediate connector 132 provides electrical continuity between electrical contact pads 130 of printed circuit board 124 and electrical contact pads 136 of printed circuit board 134. Electrical contact pads 130 of printed circuit board 124 and electrical contact pads 136 of printed circuit board 134 can be thin copper strips.

The second printed circuit board 134 includes a proximal side and a distal side. The distal side includes a corresponding number of electrical contact pads 136 for each of electrical contact pads 130 of the printed circuit board 124. Each of the electrical contact pads 136 are connected to a solder pad 138. The solder pads 138 can be on the upper or lower surfaces of the printed circuit board 134. The electrical contact pads 136 electrically connect to the solder pads 138 via copper lines 154. The copper lines 154 may appear on the upper or lower surface depending on the available surface real estate. The printed circuit boards 124 and 134 may be manufactured by alternately stacking layers of epoxy resin and fiberglass and embedded copper lines. Solder pads 138 are a way of electrically connecting the individual wires of the cable 166 shown in FIG. 1 to pins 128. Each wire of the cable 146 may be exposed and soldered to a solder pad 138. This provides electrical continuity between the pins 128 to the wires in the cable 166. The printed circuit board 134 includes an opening 156 surrounded by a copper pad 150 that extends around the periphery of the opening 156 and also covers the internal bore of the opening 156. The electrical pad 158 may be provided to electrically ground the metal housing parts 102 and 104. Opening 156 in the printed circuit board 134 allows a mechanical fastener 142 to be inserted through the opening 140 in the lower housing 104, and through the printed circuit board 134, and into a threaded receptacle in the underside of the upper housing 102 to thereby mechanically connect the upper housing 102 to the lower housing 104, and thereby retaining the assembly of components.

The distal side of the lower housing 104 includes a cutout with side walls 144. When lower housing 104 is mated with the upper housing 102, the side walls 144 will fit within slots 120 of the male connector portion 118 to join the lower housing 104 to the male connector portion 118. The lower housing 104 includes a tongue 170 that extends on the distal side of the lower housing 104. The pin holder 126 has a recessed step 172 that fits against the tongue 170, when the connector 100 is assembled.

Figure 3:
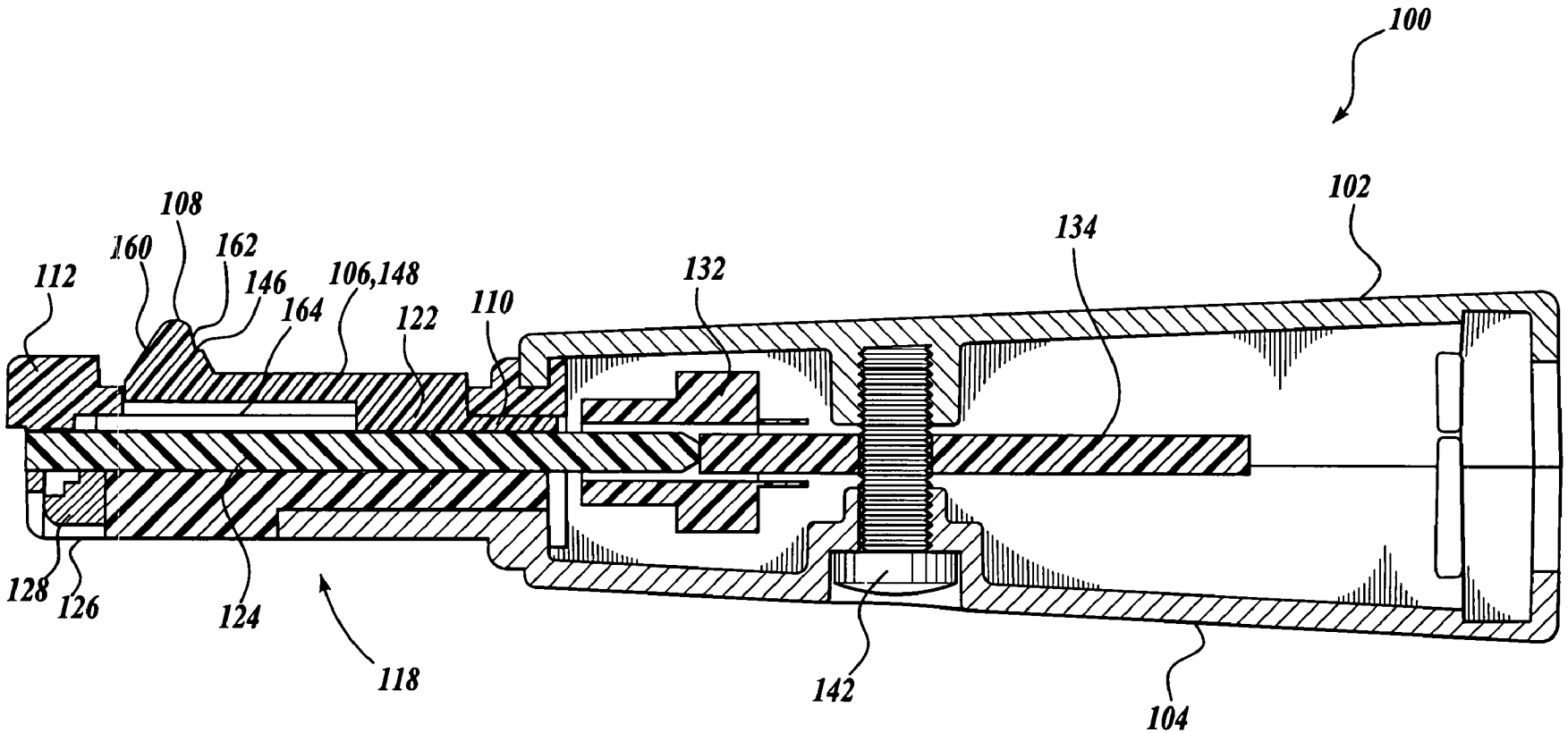
FIG. 3 is a cross-section illustration of a quick-release connector in accordance with one embodiment of the present invention.

FIG. 3 is a cross-section illustration of the connector 100 made in accordance with one embodiment of the present invention. As can readily be appreciated from FIG. 3, the tang 148 of the locking mechanism 106 is elevated above the upper surface of the printed circuit board 124, thereby creating a cavity 164. The tang 148 is connected to the base 110 at the connection point 122, thus, allowing the distal side of the tang 148 to flex downward within the cavity 164. The connection point 122 flexes to return the tang 148 to the unflexed configuration as illustrated in FIG. 3. The detent 108 also flexes downward with the tang 148 when coming in contact with a solid surface, which impacts the frontal sloping surface 160 of detent 108.

After the male connector portion 118 of the connector 100 is within a socket and a pulling force is applied on the connector 100, which transfers the pulling force against the rear sloping side 162, the force applied to the sloping side 162 of detent 108 will cause the distal portion of the tang 148 to flex downwardly, disengaging the detent 108, thus releasing the connector 100 from the socket. During insertion and release, the flexing of the tang 148 via the detent 108 is due to an impact on either the front sloping surface 160 or the rear sloping surface 162 of detent 108. As can be appreciated, FIG. 3 also illustrates the function of the internal, intermediate connector 132 to electrically connect the pins 128 through the printed circuit board 124 to the printed circuit board 134 and to the cable 166. The internal, intermediate connector 132 provides for ease in assembly of the connector 100. For example, the printed circuit board 134 can be soldered to the individual wires of the cable 166 and then inserted and soldered to the internal, intermediate connector 132, which is next connected to the printed circuit board 124.

Figure 4:
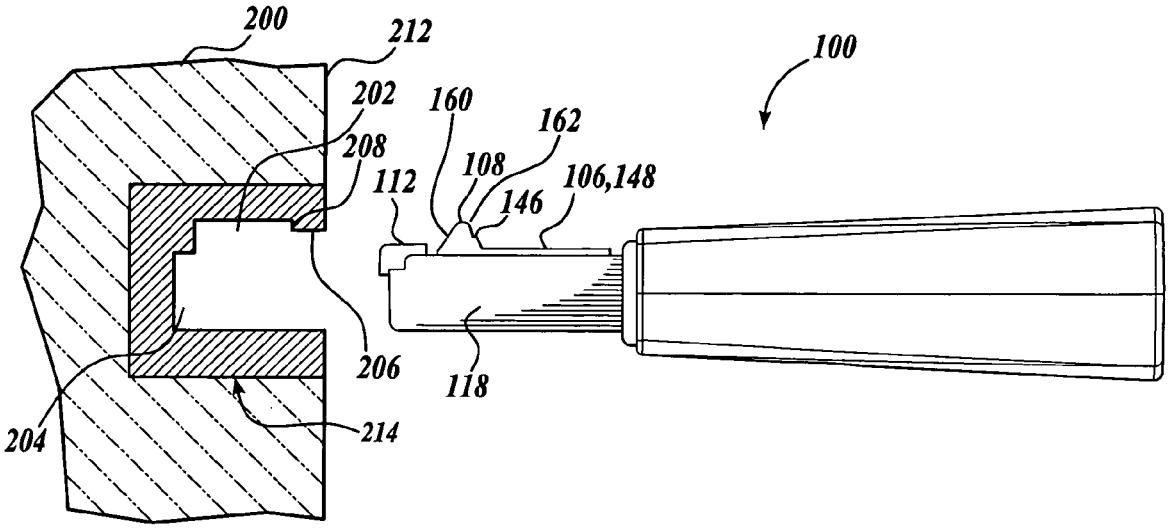
FIGS. 4-5 illustrate the method of inserting a quick-release connector within a socket in accordance with one embodiment of the present invention.
Figure 5:
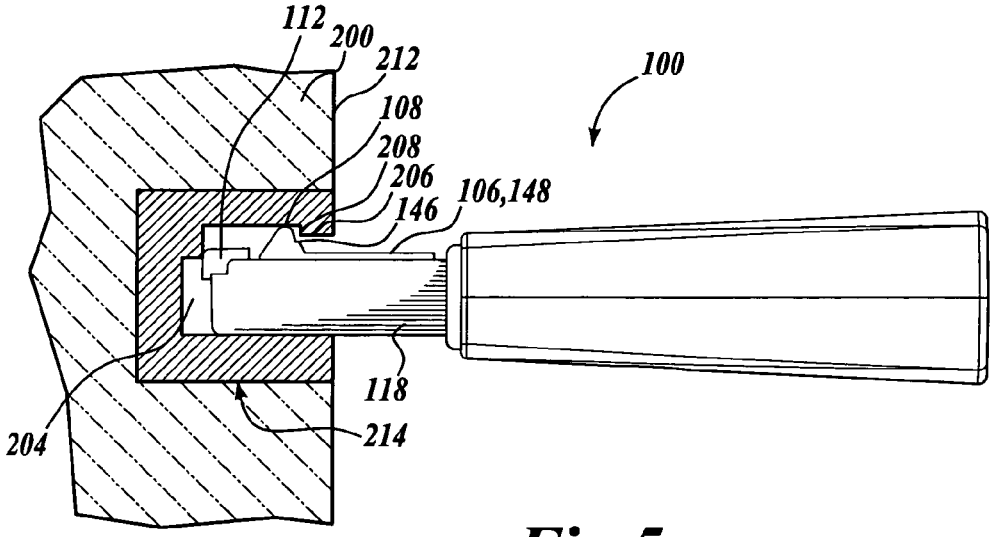

Referring to FIGS. 4-5, one method of using the connector 100 is illustrated. Beginning with FIG. 4, the connector 100 is exterior to a device 200 containing a socket 214. The socket 214 includes two channel sections. The socket 214 includes channel 202 that corresponds to the width and height corresponding to the frontal guide block 112 to accept the frontal guide block 112 therein. The socket 214 includes a second channel 204 with a width corresponding to the male connector portion 118. The socket 214 includes a lip 206 protruding downward from the front edge of the socket 214 into the channel 202.

During the insertion process, the frontal sloping surface 160 of the detent 108 impacts the wall 212 of the device 200 at an angle, thereby causing a downward force that flexes the distal portion of the locking mechanism 106 and the tang 148 downwardly. The detent 108 assumes this flexed configuration while the male connector portion 118 is being inserted into the socket 214. The detent 108 passes under the lower surface of lip 206 while in this flexed configuration.

Referring to FIG. 6, as soon as detent 108 passes by the lower surface of lip 206, the tang 148 is restored to the unflexed configuration and the detent 108 assumes a position behind the rear wall 208 of lip 206. This action provides a sturdy, locking connection between the connector 100 and the device 200. However, unlike conventional connectors, the rear sloping side 162 of the detent 108 allows the connector 100 to be released from the socket 214 without manually depressing either a locking mechanism or a manual tab to disengage the detent 108 from behind the lip 206. The connector 100 can be released from the socket 214 when a sufficient pulling force is applied to the connector 100. The height of the step or shoulder 146 on the rear sloping side 162 of the detent 108 can determine the amount of engagement between detent 108 and the lip 206. When a reverse force is applied to the connector 100, the rear sloping side 162 of the detent 108 is impacted by the rear wall 208 of lip 206, and a downward force is created that flexes the locking mechanism 106 and, in particular, the tang 148 downwardly. The downward motion of the tang 148 and detent 108 releases the connector 100 from the socket 204. Therefore, the connector 100 is released from the socket 214 without the need for a manual actuation of a latching mechanism or the need for a manual actuation of a tab, thereby avoiding any breakage of the locking mechanism 106 by an accidental or an inadvertent tension placed on the cable 166.

While illustrative embodiments have been illustrated and described, it will be appreciated that various changes can be made therein without departing from the spirit and scope of the invention.

The embodiments of the invention in which an exclusive property or privilege is claimed are defined as follows:

1. An electrical connector, comprising:

(a) a housing attached to a cable;

(b) an intermediate connector having a receptacle for removably receiving electrical contact pads, the intermediate connector electrically connected to the cable within a cavity of the housing;

(c) a male connector portion connected to the housing, comprising:

(i) one or more electrical contact pins for electrically connecting the connector to a socket when the connector is inserted into the socket; and (ii) one or more electrical contact pads that are removably received in the intermediate connector such that, when assembled, the one or more electrical contact pins and the cable are electrically connected via the removably received electrical contact pads and the intermediate connector; and (d) a locking mechanism removably received in the male connector portion, comprising:

(i) a flexible tang; and (ii) a detent having a rear sloping surface with an external angle of more than 90° with located on the surface of the tang that locks into a corresponding feature of the socket, such that the detent is releasable from the socket upon application of an axial force to the connector.

2. The electrical connector of claim 1, wherein the detent is located on a flat, planar surface of the tang.

3. The electrical connector of claim 1, wherein the detent has a front sloping surface.

4. The electrical connector of claim 1, wherein the detent has a pyramidical profile with an apex having a front sloping surface and a rear sloping surface that slopes from the apex with a step on the rear sloping surface that limits the amount of upward flexing against a socket.

5. The electrical connector of claim 1, wherein the detent comprises a first and a second tooth separated by a gap, wherein each tooth has an apex and a front sloping surface and a rear sloping surface.

6. The electrical connector of claim 1, wherein the connector is an RJ-45 connector.

7. The electrical connector of claim 1, wherein the tang is attached to a base at a proximal side but detached from the base at a distal side, and the tang is elevated above the surface of the base that creates a cavity below the tang such that the tang can flex downwards.

8. An electrical connector, comprising:

(a) a housing attached to a cable;

(b) electrical contact pins removably supported by the housing that electrically connect the connector to a device;

(c) a locking mechanism removably received in the housing, comprising;

(i) a flexible tang; and (ii) a detent located on the surface of the tang that locks into a corresponding feature of a socket, such that the detent is releasable from the socket upon application of an axial force to the connector; and (d) an intermediate connector for removably electrically coupling the electrical contact pins to the cable.

9. The electrical connector of claim 8, wherein the detent is located on a flat, planar surface of the tang.

10. The electrical connector of claim 8, wherein the detent has a front sloping surface.

11. The electrical connector of claim 8, wherein the detent has a pyramidical profile with an apex having a front sloping surface and a rear sloping surface that slopes from the apex with a step on the rear sloping surface that limits the amount of upward flexing against a socket.

12. The electrical connector of claim 8, wherein the detent comprises a first and a second tooth separated by a gap, wherein each tooth has an apex and a front sloping surface and a rear sloping surface.

13. The electrical connector of claim 8, wherein the connector is an RJ-45 connector.

14. The electrical connector of claim 8, wherein the tang is attached to a base at a proximal side but detached from the base at a distal side, and the tang is elevated above the surface of the base that creates a cavity below the tang such that the tang can flex downwards.

* * * * *

UNITED STATES PATENT AND TRADEMARK OFFICE

CERTIFICATE OF CORRECTION

PATENT NO. : 7,470,137 B2
APPLICATION NO. : 11/392249
DATED : December 30, 2008
INVENTOR(S) : W. H. Burke et al.

It is certified that error appears in the above-identified patent and that said Letters Patent is hereby corrected as shown below:

| COLUMN | LINE | |
|---|---|---|
| (75)<br>Pg. 1, col. 1 | Inventors | "**Sena R Janky,**" should read<br>**--Sena R. Janky,--** |
| (75)<br>Pg. 1, col. 1 | Inventors | "**Corey B Vettleson,**" should read<br>**--Corey B. Vettleson,--** |
| 6<br>(Claim 1, | 32<br>line 22) | after "more than 90°" delete "with" |

Signed and Sealed this
Fifth Day of April, 2011

David J. Kappos

David J. Kappos
*Director of the United States Patent and Trademark Office*